US006004362A

United States Patent [19]

Seals et al.

[11] Patent Number: 6,004,362

[45] Date of Patent: Dec. 21, 1999

[54] METHOD FOR FORMING AN ABRASIVE SURFACE ON A TOOL

[75] Inventors: Roland D. Seals, Oak Ridge; Rickey L. White, Harriman; Catherine J. Swindeman; W. Keith Kahl, both of Knoxville, all of Tenn.

[73] Assignees: Lockheed Martin Energy Systems; Lockheed Martin Energy Research Corp., both of Oak Ridge, Tenn.

[21] Appl. No.: 09/017,546

[22] Filed: Feb. 2, 1998

[51] Int. Cl.[6] ..... B24D 3/00; B24D 3/06; B24D 5/00; B24D 18/00

[52] U.S. Cl. ..... 51/295; 51/307; 51/309; 51/293; 451/540; 451/552; 427/446; 427/452; 427/453; 427/532; 427/535; 427/540; 427/576; 427/299

[58] Field of Search ..... 51/295, 307, 309, 51/297, 293; 427/446, 447, 452, 453, 532, 535, 540, 576, 578, 299, 301, 304, 330, 190, 191; 428/148, 701, 702, 699; 451/540, 552

[56] References Cited

U.S. PATENT DOCUMENTS

| | | | |
|---|---|---|---|
| 4,075,371 | 2/1978 | Patel | 427/452 |
| 4,115,959 | 9/1978 | McCormick | 427/447 |
| 4,173,685 | 11/1979 | Weatherly | 427/190 |
| 5,573,444 | 11/1996 | Ryoke et al. | 451/28 |
| 5,651,801 | 7/1997 | Monroe et al. | 51/309 |
| 5,755,299 | 5/1998 | Langford, Jr. et al. | 51/295 |
| 5,756,217 | 5/1998 | Schroder et al. | 51/309 |

*Primary Examiner*—Michael Marcheschi
*Attorney, Agent, or Firm*—Quarles & Brady

[57] ABSTRACT

A method for fabricating a tool used in cutting, grinding and machining operations, is provided. The method is used to deposit a mixture comprising an abrasive material and a bonding material on a tool surface. The materials are propelled toward the receiving surface of the tool substrate using a thermal spray process. The thermal spray process melts the bonding material portion of the mixture, but not the abrasive material. Upon impacting the tool surface, the mixture or composition solidifies to form a hard abrasive tool coating.

26 Claims, No Drawings

METHOD FOR FORMING AN ABRASIVE SURFACE ON A TOOL

STATEMENT REGARDING FEDERALLY SPONSORED RESEARCH OR DEVELOPMENT

This Invention was made with government support under contract DE-AC05-96OR22464, awarded by the United States Department of Energy to Lockheed Martin Energy Research Corporation, and the United States Government has certain rights in this invention.

FIELD OF THE INVENTION

This invention relates generally to tools used for grinding, cutting or machining, and more particularly to a method of forming a high-performance abrasive coating on the surface of such a tool.

BACKGROUND OF THE INVENTION

Tools used for grinding, cutting and machining, are often manufactured with abrasive surface coatings. Manufacturers of such tools are constantly looking for ways to improve the functionality and performance of such tools. There is a broad spectrum of tools used for such purposes, such as drill bits, saws, knives and grinding wheels. Also, large-area and complex-shaped tools are used for a variety of functions such as tunneling, oil well drilling and bulldozing. In addition to improving tool performance, manufacturers are continually striving for improved methods of fabricating such tools. In particular, there is a common need in the industry to find improved methods of fabricating abrasive surface coatings for tools.

Numerous methods have been devised to form abrasive surface coatings on tools. Generally, rigid abrasive tools are manufactured by applying abrasive particles, mixed with a bonding agent, to the working surface of the tool. The "working surface," as used herein, is the tool surface which performs the cutting, grinding, or machining. For some applications, the abrasive/bonding composite material is formed and solidified prior to attachment to the working surface of the tool by an adhesive backing. For other applications, the composite material is formed and then applied, as a slurry, to the working surface of the tool, where the slurry subsequently solidifies and cures. For example, U.S. Pat. No. 5,551,959 to Martin et al. describes a high-performance abrasive coating which is manufactured by incorporating variations of these general methods. These methods are expensive and labor intensive. In addition, they are not amenable to coating large-area and complex-shaped tool surfaces.

Still other methods have been developed which make it more feasible to deposit abrasive coatings to complex shaped surfaces, by depositing the abrasive coating as a chemical vapor using either physical vapor deposition (PVD) or chemical vapor deposition (CVD). For instance, U.S. Pat. No. 5,588,975 to Hammond et al. describes a method for manufacturing a grinding tool in which the abrasive coating of the working surface of the tool is applied as a plasma. However, these methods have inherent limitations, such as the use of vacuum equipment, which limits the abrasive coating applications to small tool substrates. In addition, such methods are expensive and not amenable to an automated production environment.

For the foregoing reasons, it would be desirable to have an efficient and inexpensive method for depositing high-performance abrasive coatings on tools, including those having large surface areas and/or complex surface shapes. The method should provide a means for applying a variety of abrasive coating compositions to different types of tools, without producing byproducts which are harmful to the environment. Furthermore, the method should be flexible enough to be used in an efficient automated assembly environment.

SUMMARY OF THE INVENTION

A method for fabricating a tool used in cutting, grinding and machining operations, is provided. The method may be used to deposit a variety of abrasive and bonding agent materials upon a working surface of a metal, composite, ceramic, or polymer tool substrate. According to the method, a tool substrate, an abrasive material, and a bonding or matrix material are provided. The tool substrate can comprise metal, ceramic, organic or composite materials. The abrasive can be selected from a variety of abrasives including metal, ceramic, organic or composite materials. The bonding material may comprise a metal, organic, or vitrifiable bonding material. The abrasive and bonding materials may be supplied in powder form, or as a solid feedstock, examples of which include wire, cord and rod form.

The materials are propelled, either individually or combined, toward a receiving surface of the tool substrate to be coated. The step of propelling the materials is achieved using a thermal spray process in which the materials are subjected to a thermal energy source which acts to melt the bonding matrix material, but not the abrasive material. In the case of a solid feedstock, such as wire, the feedstock is fed through the thermal energy source, subjecting only a portion of the feedstock to the thermal energy source at any given time. The abrasive and molten bonding material are simultaneously propelled by a gas stream which accelerates them toward the receiving surface of the tool substrate. Upon impact, the abrasive/bonding material composition bonds to the surface and solidifies to form a hard abrasive coating thereon. Examples of suitable thermal spray deposition techniques include plasma spraying, combustion spraying, and wire arc spraying.

DETAILED DESCRIPTION OF PREFERRED EMBODIMENTS

A method is provided for forming an abrasive coating on the working surface of a cutting, grinding or machining tool. The method provides a manufacturing technique for depositing common and advanced abrasive coatings, using thermal spray technology, onto the working surface of tools having a variety of shapes and sizes. The method is applicable to a variety of tools, ranging from smaller tools such as drill bits, saws, knives and grinding wheels, to large-area and complex-shaped tools for such uses as tunneling, oil well drilling and bulldozing.

Initially, a tool substrate having a surface portion requiring an abrasive coating is provided. The tool substrate may comprise a metal, ceramic, polymer or composite material. Abrasive and bonding materials are also provided. It should be noted that the terms "bonding material," "bonding agent," "matrix," "matrix material," and "bonding matrix" are used interchangeably throughout this specification, to refer to the medium in which the abrasive particles or grains are eventually fixed. The abrasive and bonding materials chosen will vary depending upon the particular application. However, it is generally preferred that the bonding material adhere to both the receiving surface of the tool and the surface of the abrasive particles. Other material characteristics must also be taken into account when choosing the materials to be used for a given application. For example, the coefficient of thermal expansion (CTE) of the tool substrate, bonding material, and abrasive are all important characteristics. Material CTE mismatches may result in poor adhesion between the bonding material and the abrasive particles, or between the bonding material and the receiving surface of the tool substrate.

The abrasive and bonding materials may be provided in a number of different forms. For example, they may be provided as individual or mixed powders. Alternatively, the abrasive and bonding materials may be supplied as a combined solid feedstock, in shapes such as rods, cords and wires. Bonding materials supplied as a solid feedstock may be mixed, such that the abrasive particles are fixed in a bonding material matrix. Alternatively, the abrasive particles may be supplied as a powder encapsulated in the hollow portion of a cored wire. As used herein, the term "feedstock" refers to the abrasive and bonding materials being applied to the tool surface.

A host of different abrasive materials may be used with the method of abrasive coating formation. Preferably, the abrasive materials comprise abrasive grains which have grain sizes ranging from approximately 5–250 microns. For the purposes of this specification, the term "grain size" is defined as the average grain diameter. It will be apparent to one skilled in the art that there are many types of abrasive materials which are applicable to the invention. Some examples of suitable abrasives include: diamond (natural or synthetic); cubic boron nitride; boron carbide; tungsten carbide; silicon carbide; and aluminum oxide.

In some instances, it may be desirable to provide abrasives having metallic surface coatings. For instance, metal coated abrasives may be required to enhance bonding between individual abrasive particles and the surrounding bonding material. For example, when an uncoated ceramic abrasive is mixed in a metal matrix material, chemical bonding between individual ceramic particles and the metal matrix may be weak, resulting in loosening of the abrasive from the bonding matrix—especially when the tool is being used on a workpiece. Furthermore, differences between the coefficients of thermal expansion (CTE) of a ceramic abrasive and a metal matrix may cause additional weakening at the abrasive/matrix interface during solidification, or cooling, of the matrix material. Providing a metal abrasive coating having a CTE closer to that of the metal matrix material will lessen this weakening effect.

Depending upon the tool application, a bonding matrix material may wear down more quickly than desired. Known methods generally employ liquid lubricants to the surface of the tool to lessen this effect. The lubricant reduces the friction between the abrasive coating surface and the workpiece. The present invention can employ solid lubricants to perform this function. The solid lubricants counteract the accelerated wearing of the matrix material. Solid lubricants may be co-deposited with the abrasive and matrix materials. Some examples of suitable solid lubricants include graphite (C), hexagonal boron nitride (h-BN), molybdenum disulfide (MoS2), and molybdenum disilicide (MoSi2).

A number of different metal, ceramic, and organic bonding materials are suitable. For instance, metal materials include aluminum, bronze, brass, copper, copper-aluminum, and other low melting metals and metal alloy systems, as well as mixtures of these materials. Suitable vitrifiable bonding materials include silicon-bonded silica (e.g., 30% Si—SiO2), cordierite, mullite, ceramic silicate blends, clay mineral silicates, ortho- and ring-structure silicates, chain- and band-structure silicates, and framework-structure silicates and zeolites. Suitable organic bonding materials include thermoplastics, thermosets, and precursor resins to glass carbon, such as phenolic and furan resins, and mixtures thereof. The bonding materials can comprise self-fluxing (or self-fusing) alloys, such as Ni—Cr—B—Fe—Si—C, Ni—Cr—B—Fe—Si—Cu—Mo—C, Ni—Cr—B—Fe—Si—Cu—Mo—W—C, Ni—(WC-12 Co)—Cr—Fe—Si—B—C, Co—Ni—Cr—Mo—Si—Fe—C, and additional blends containing silicas and/or silicates. A "self-fluxing" alloy is an alloy which does not require the addition of a flux in order to wet the substrate and coalesce when heated. The ability to use self-fluxing alloys is a significant advantage of this invention compared to existing abrasive coating techniques. The use of self-fluxing alloys is generally limited to thermal spray deposition methods; known abrasive deposition methods do not generally employ self-fluxing alloys.

The abrasive and bonding materials are deposited onto the receiving surface of a tool substrate using a thermal spray coating process. Abrasive and bonding materials are introduced into the thermal spray apparatus. For example, a carrier gas may be used to inject powdered abrasive and bonding materials into the apparatus. Alternatively, the abrasive and bonding materials may be fed into the apparatus as a solid feedstock such as a wire. While passing through the thermal spray apparatus, the materials are subjected to a thermal energy source which melts the bonding material. A high velocity gas stream propels the abrasive and molten bonding materials toward a receiving substrate. Preferably, the melted bonding material is propelled as a spray of particles, ranging from 5–200 microns in size. Upon impacting the receiving surface, the bonding material flows and interlocks with the surface and the abrasive particles to solidify, forming a hard abrasive coating.

In some instances, it may be desirable to cool the tool substrate to expedite the bonding/solidification process. For example, cooling jets of air or another gas can be directed toward a backside portion of the tool substrate opposite the receiving surface. In some instances, it may be desirable to pretreat the receiving surface, prior to depositing the abrasive coating. Mechanical roughening can be used to increase the surface area available for mechanical interlocking between the bonding material and the receiving surface. Chemical treatment can be used to clean the surface, thereby enhancing the potential for chemical bonding.

The invention can be utilized with different abrasive thermal spray coating techniques. In general, thermal spray coating may be subdivided into three different thermal spray processes: plasma spraying, combustion spraying, and wire-arc spraying. For each of these processes, equipment is readily available which can be used with the instant method. Miller Thermal, Inc. (Appleton, Wis.) manufactures the Model 4500 plasma spray system and BP400 wire arc spray system, both of which are amenable to the instant method. Furthermore, the Eutectic-Castolin Group (Lausanne, Switzerland) manufactures the Terodyne 3000 flame spray system for low-velocity combustion spraying, and Sulzer-Metco (Westbury, N.Y.) manufactures the DJ2000 gun for high-velocity combustion thermal spraying, both of which can be used with the instant method.

Thermal plasma spray deposition utilizes abrasive and matrix materials which are provided in powder form. A plasma jet, comprising an inert gas, is superheated by passing it through a direct current (dc) arc. The abrasive and matrix materials are injected, using a carrier gas, into the plasma jet. Injection into the plasma jet may be either internal or external. Internal injection refers to injection directly into the spraying appratus. In the case of internal injection, the injected material is introduced into the apparatus before being subjected to the thermal energy source. In the case of external injection, the material is introduced into the plasma jet outside of the thermal spray apparatus. For example, the material being externally injected can be introduced at the location where the plasma jet exits the spray apparatus, such as the nozzle of a thermal spray gun. In the case of external injection of the bonding material, the plasma jet should be sufficiently heated to melt the bonding material upon its introduction into the plasma jet. On the other hand, the abrasive material can be externally injected without concern for the temperature of the plama jet, since it not necessary to melt the abrasive material. The materials may be injected individually or as a single, integral feedstock. Where the materials are combined as a single feedstock, the relative concentration of abrasive-to-bonding material is predetermined. In the case of separate injection, the relative concentration of abrasive-to-bonding agent may be altered by varying the individual feed rates. The carrier gas transports the materials into the degenerated plasma jet, where the matrix material particles are melted. The plasma jet, including the abrasive and matrix materials, is then directed toward the substrate to form the abrasive coating. The spray rate may be altered, depending upon the substrate, abrasive, and matrix materials being used.

Wire arc thermal spraying employs an electric arc, with feedstocks usually in the form of wires, to melt the bonding material. In one embodiment, a pair of wires, comprising the feedstock material, are fed through the electric arc spray apparatus. The wires are electrically conductive or, alternatively, have an electrically conductive sheath covering. The wires are fed through an electric arc spray gun such that the tips of the wires are forced to come close together. With the use of a power source, an electrical potential is created between the two wires such that an electric arc is formed as the wires approach one another. The electric arc melts the bonding material, forming a molten drop at the wire tips. Preferably, the molten drop contains the abrasive particles. Alternatively, the abrasive material may be externally injected. An atomizing gas is directed at the arc region, propelling the molten drops toward the receiving surface of the tool substrate. Cored wires are preferred, with the outer portion of the cored wire comprising a bonding material. The inner portion of the cored wires can comprise either abrasive material, or an abrasive material/bonding material mixture. Where the abrasive material is externally injected, the wire can comprise bonding material alone. In an alternate embodiment of the instant process, wire arc thermal spraying comprises the introduction of a single wire feedstock through the electric arc spray apparatus. Where a single-wire arc spray process is employed, an electric arc is created between a single feedstock wire and a stationary electrode. In this case, the stationary electrode does not comprise feedstock material.

Low-velocity combustion thermal spraying, also referred to as flame spraying, is the simplest and most versatile of the thermal spray coating processes. Using this thermal spray process, abrasive and matrix materials may be supplied in either powder, wire or rod forms. Fuel gas (e.g., acetylene, propane, natural gas, hydrogen, or methyl-acetylene-propadiene) is fired with oxygen, forming a flame which heats and melts the bonding material. The combustion flame melts the powder or the wire/rod tip and propels the molten particles toward the receiving surface of the tool substrate. This process is preferred for the deposition of polymeric thermoplastics or thermosets and low melting point metallic materials. Flame spray guns are inexpensive, light and compact, relative to the other coating methods described herein. However, low particle velocities associated with this method may result in porous, lower-density coatings with lower bond strengths between the matrix material and the receiving substrate.

High Velocity Oxy-Fuel (HVOF) combustion thermal spray deposition is a high velocity combustion process that operates with an oxygen-fuel mixture, with the fuel typically consisting of either propylene, propane, hydrogen, acetylene or liquid kerosene. This process uses extremely high kinetic energy and controlled thermal energy output to produce low porosity coatings with high bond strengths, fine as-sprayed surface finishes, and low residual stress. Abrasive and matrix materials, preferably in the form of powders or wires, are injected axially into a flame extending from a combustion nozzle; this ensures uniform heating of the materials as they exit the spray nozzle. The gases undergo rapid expansion through a restricted nozzle when combusted with oxygen, accelerating the melted particles and solid abrasive to high velocities (i.e., approaching 1,370 m/sec). This method typically results in lower porosity, lower oxide content and higher coating adhesion than other thermal spray methods such as plasma spray deposition. HVOF coatings typically provide improved machinability characteristics as compared to low velocity, flame-sprayed coatings.

An abrasive coating having a gradient structure can be formed by the method of the invention. Gradient formation may consist of varying the abrasiveness of the coating surface over a given area of the receiving surface. Alternatively, an abrasive gradient structure may be formed normal, or perpendicular, to the substrate surface. In the latter case, the abrasiveness of the coating surface will change, according to the gradient structure, with tool use as wearing occurs. There are a variety of ways to form a gradient structure. Gradient formation may be based upon abrasive grain size distribution, abrasive grain concentration, grain composition, or a combination thereof. In instances where the abrasive and bonding materials are fed separately into the thermal spray apparatus, the abrasive-to-matrix material concentration may be altered by varying the relative feed rates of the two materials. A gradient may be achieved across the receiving surface by adjusting the individual feed rates while moving the spray direction over the receiving surface. A gradient structure normal to the receiving surface can be achieved by adjusting the individual feed rates while applying the abrasive and bonding materials to a given surface area. It will occur to one skilled in the art that additional techniques, as well as other variations and combinations of the aforementioned gradient formation methods, may be employed. For example, different combinations of matrix and abrasive materials may deposited on a single tool receiving surface.

The application of thermal spray technology to the deposition of abrasive coatings for tools provides numerous advantages over existing abrasive coating techniques for tools. The methods described herein are less expensive, more efficient, and faster than existing abrasive coating technologies, such as chemical vapor deposition. Furthermore, because the thermal spray techniques used with the present method do not produce the volatile organics associated with known abrasive coating techniques, the instant invention provides a method which is not harmful to the environment.

The method is amenable to the use of many different combinations of abrasive and matrix materials. However, possibly the most significant advantage of the method, as compared to known abrasive coating methods, is the mobility of the spray apparatus. The instant abrasive coating technique takes advantage of the relatively light, small size of thermal spray equipment, such as thermal spray guns. Most existing techniques, such as PVD and CVD, must be performed in a laboratory environment under controlled vacuum. As a result of the inherent mobility of thermal spray equipment, the instant abrasive coating method may be applied to coat large area tools, such as bulldozers, oil well drills, etc. out in the field.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A method for fabricating a grinding wheel used to cut, grind, or machine a work piece, comprising the steps of:

providing a tool substrate having a receiving surface;

providing an abrasive material and a bonding material;

passing said abrasive and bonding materials through a thermal energy source, the thermal energy source melting at least the bonding material; and depositing the abrasive and bonding materials against the receiving surface to form an abrasive coating layer thereon, the abrasive layer is for cutting, grinding, or machining the work piece.

2. A method as recited in claim 1, further comprising the step, after the step of providing a tool substrate, of pretreating the receiving surface to improve adhesion of the bonding material thereto.

3. A method as recited in claim 1, further comprising the step of cooling said tool substrate.

4. A method as recited in claim 1, further comprising the step of co-depositing a solid lubricant with said abrasive and bonding materials.

5. A method as recited in claim 1, wherein said abrasive and bonding materials are provided as an integral solid feedstock.

6. A method as recited in claim 1, wherein said abrasive and bonding materials are provided in powdered form.

7. A method as recited in claim 6, further comprising the step of mixing said abrasive and bonding material powders, prior to passing said abrasive and bonding materials through said thermal energy source.

8. A method as recited in claim 6, further comprising the step of injecting said abrasive and bonding powders into a thermal spray apparatus, prior to passing said abrasive and bonding materials through said thermal energy source.

9. A method as recited in claim 1, wherein the step of passing said bonding and abrasive materials through a thermal energy source further comprises externally injecting at least said abrasive material.

10. A method as recited in claim 1, wherein said abrasive material comprises a plurality of grains having a grain size ranging from about 5 to about 250 microns.

11. A method as recited in claim 1, wherein said abrasive material comprises metal-coated grains.

12. A method as recited in claim 1, wherein said bond material comprises a metal.

13. A method as recited in claim 1, wherein said bond material is a vitrifiable material.

14. A method as recited in claim 1, wherein said bond material comprises an organic material.

15. A method as recited in claim 1, wherein said bond material comprises a self-fluxing alloy.

16. A method as recited in claim 1, wherein said abrasive material is applied so as to form the abrasive layer having a gradient structure.

17. A method as recited in claim 16, wherein said gradient structure is formed by varying the abrasive grain size distribution.

18. A method as recited in claim 16, wherein said gradient structure is formed by varying the abrasive grain concentration.

19. A method as recited in claim 1, wherein the tool substrate is coated by a plasma spraying process, the step of passing said abrasive and bonding materials through a thermal energy source comprising:

injecting said abrasive and bonding materials into a plasma jet, said plasma jet melting the bonding material and propelling said abrasive and bonding materials toward the receiving surface of said tool substrate.

20. A method as recited in claim 1, wherein the tool substrate is coated by a wire arc spraying process, the step of passing said abrasive and bonding materials through a thermal energy source comprising:

creating an electrical potential between a first electrically conductive solid feedstock and an electrode;

bringing said first electrically conductive solid feedstock and said electrode together to form an electric arc therebetween, the electric arc melting the bonding material of a portion of said first electrically conductive solid feedstock to form a molten drop; and directing an atomizing gas at said molten drop, said gas propelling said molten drop toward the receiving surface of said tool substrate.

21. A method as recited in claim 20, wherein said electrode comprises a second electrically conductive solid feedstock.

22. A method as recited in claim 20, wherein said molten drop contains abrasive material.

23. A method as recited in claim 20, wherein said abrasive material is externally injected.

24. A method as recited in claim 20, wherein said first electrically conductive solid feedstock is a cored wire, an outer portion of said cored wire comprising a bonding material, an inner portion of said cored wire comprising an abrasive material.

25. A method as recited in claim 1, wherein the tool substrate is coated by thermal spraying, the step of passing said abrasive and bonding materials through a thermal energy source comprising:

combusting a mixture of gases to form a flame; and propelling said bonding and abrasive materials through said flame, said flame melting the bonding material, said bonding and abrasive materials being deposited on the receiving surface of said tool substrate.

26. A method as recited in claim 1, wherein the tool substrate is coated by thermal spraying, the step of passing said abrasive and bonding materials through a thermal energy source comprising:

injecting said abrasive and bonding materials into a thermal spray apparatus having a restricted nozzle, said restricted nozzle having a flame extending therefrom; and combusting an oxygen-fuel mixture, said combustion accelerating said bonding and abrasive materials axially through said flame toward the receiving surface of said tool substrate, said flame melting said bonding material.

* * * * *